US008643468B1

(12) United States Patent
Peabody et al.

(10) Patent No.: US 8,643,468 B1
(45) Date of Patent: Feb. 4, 2014

(54) ELECTRIC STRIKE WITH INTEGRATED PROXIMITY READER

(75) Inventors: Joshua T. Peabody, Phoenix, AZ (US); Michael Webb, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 1200 days.

(21) Appl. No.: 12/009,972

(22) Filed: Jan. 22, 2008

Related U.S. Application Data

(60) Provisional application No. 60/897,032, filed on Jan. 23, 2007.

(51) Int. Cl.
*H01H 35/00* (2006.01)

(52) U.S. Cl.
USPC ..... 340/5.73; 340/10.1

(58) Field of Classification Search
USPC ..... 340/5.1, 5.2, 5.6, 5.61, 5.7, 5.73, 10.1
See application file for complete search history.

(56) References Cited

U.S. PATENT DOCUMENTS

| | | | | |
|---|---|---|---|---|
| 3,751,088 | A | 8/1973 | Schlage | |
| 4,339,746 | A * | 7/1982 | Ulicki et al. | 340/518 |
| 4,581,634 | A | 4/1986 | Williams | |
| 4,788,517 | A | 11/1988 | Meister | |
| 5,134,392 | A | 7/1992 | Takeuchi et al. | |
| 6,005,306 | A * | 12/1999 | Pickard | 307/117 |
| 6,049,268 | A * | 4/2000 | Flick | 340/425.5 |
| 6,816,760 | B1 * | 11/2004 | Namaky | 701/29 |
| 7,052,054 | B2 * | 5/2006 | Luker | 292/201 |
| 7,199,702 | B2 | 4/2007 | Lizza | |
| 7,274,301 | B1 | 9/2007 | Smith et al. | |
| 2002/0027498 | A1 | 3/2002 | Stephane | |
| 2005/0161960 | A1 * | 7/2005 | Ward | 292/341.16 |
| 2006/0192396 | A1 | 8/2006 | Frolov et al. | |

* cited by examiner

*Primary Examiner* — Jennifer Mehmood
*Assistant Examiner* — Yong Hang Jiang
(74) *Attorney, Agent, or Firm* — Woods Oviatt Gilman LLP

(57) ABSTRACT

An access control device for a closure such as a frame mounted door having a latch bolt. The device has a electric strike in a housing, the electric strike having a cavity cooperable with the latch bolt. A proximity reader is integrated into the electric strike housing and, when installed in the door frame, is located in a secure position at least partially shielded by the electric strike. The antenna for the proximity reader may be integrated into the electric strike housing or may be remotely installed in the frame or other convenient location proximate the reader.

12 Claims, 14 Drawing Sheets

ELECTRIC STRIKE WITH INTEGRATED PROXIMITY READER

CROSS REFERENCE IS MADE TO RELATED APPLICATION

This application is based on U.S. Provisional Patent Application Ser. No. 60/897,032, filed Jan. 23, 2007, entitled "Proximity Reader Integration Into an Electric Strike."

FIELD OF THE INVENTION

The present invention relates to a security system and more particularly to an access control system having a proximity reader integrated into an electric strike as used with a conventional door lock.

BACKGROUND OF THE INVENTION

A proximity reader is a device used to power and validate access credentials using radio frequencies to control an electric strike. A proximity reader contains a microcontroller to decode information.

An antenna transmits and receives radio frequency signals. When a proper credential, such as a proximity card or key tag, is swiped, information received by the antenna is decoded by the proximity reader to activate or open the electric strike.

Normally, the antenna and proximity reader are contained in a single housing. The housing is normally mounted to the exterior of the wall or door frame, neither of which are considered secure locations. The electric strike is then installed separately in the door frame. The present invention separates the proximity reader from the antenna and incorporates the proximity reader within the electric strike or directly to the bottom or side of the electric strike, either location being secure inside the door frame. The electric strike also provides a location for mounting the antenna directly to the electric strike, thus requiring only one frame modification for installation of the system. Alternatively, the antenna may be remotely mounted proximate the electric strike.

The need for locating the proximity reader in a secure place is well documented in technical articles appearing in various electronic and printed publications. Two examples clearly stating the need to protect the housing for the card or proximity reader are:

Vaas, Lisa,"2 Screws, 1 plastic Cover, How many Airports Infiltrated," eWeek: Aug. 6, 2007.

Knight, Hunter, "Trivially Vulnerable?," Washington Post Blog: Aug. 6, 2007.

BRIEF SUMMARY OF THE INVENTION

Briefly, the present invention incorporates the proximity reader and, in some cases, the antenna into the electric strike as an integral assembly. The benefit of this integration is twofold, providing easier installation and additional security. Without integration of the proximity reader components into the electric strike, the door frame must be modified separately using two different trades in order to install both components. This often results in a mismatch between the electric strike and the access control system. With the present invention, the door frame need only be modified once. The integration of these components into a single unit allows easier installation for the installer and ensures compatibility of the system.

The integration of the electric strike and proximity reader may be implemented in a single housing containing both components or may be a modular assembly with the proximity reader mounted to the electric strike housing.

Another benefit of the present invention is that it is not necessary to enclose the proximity reader within the antenna housing. Accordingly, the dimensions of the antenna are not driven by proximity reader board size, but rather by the optimization of the read range and performance of the antenna. This, in turn, permits the normally rather large proximity reader and antenna assembly used on doorframes or on adjacent walls to be greatly reduced in size providing a smaller footprint on the mounting surface. The 1½" by 3" antenna box size, common in today's installations, can now be reduced to a footprint approximately the size of a postage stamp, detracting less from the appearance of the door opening.

The antenna may also be mounted directly on the electric strike so as to be accessible on the lip side of the door frame or, alternatively, the remote antenna may be mounted at any convenient location on the exterior side of the door frame or wall, or at a right angle to the door frame and adjacent the interior side of a window (side light) next to the door frame.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
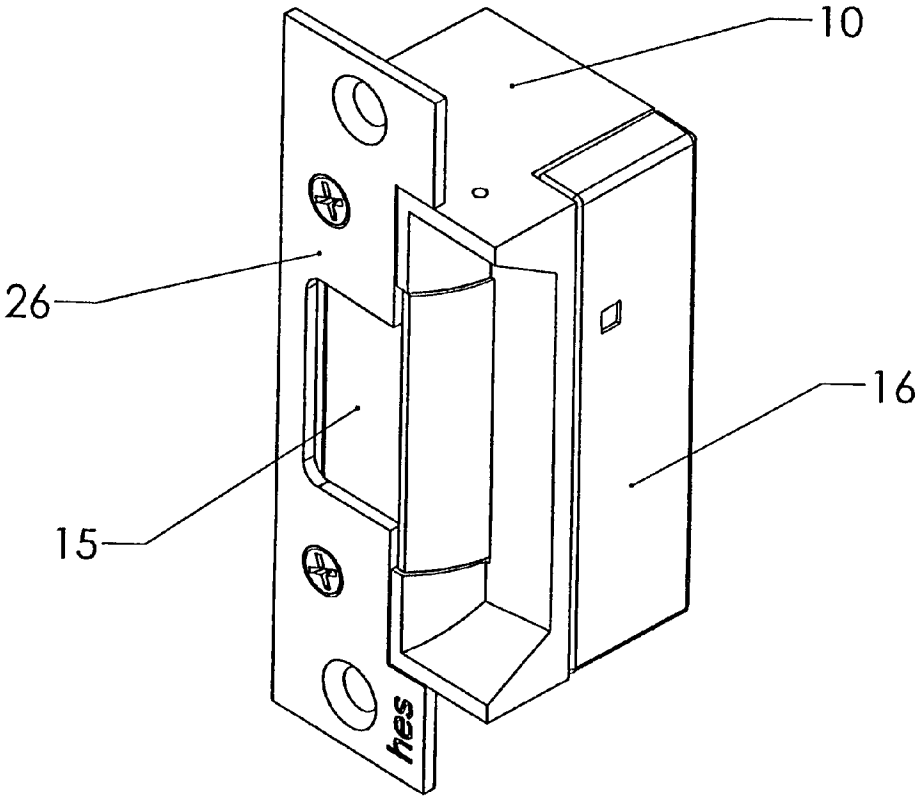
FIGS. 1, 3 and 4 are views showing the antenna and proximity reader incorporated into the electric strike.
Figure 2A:
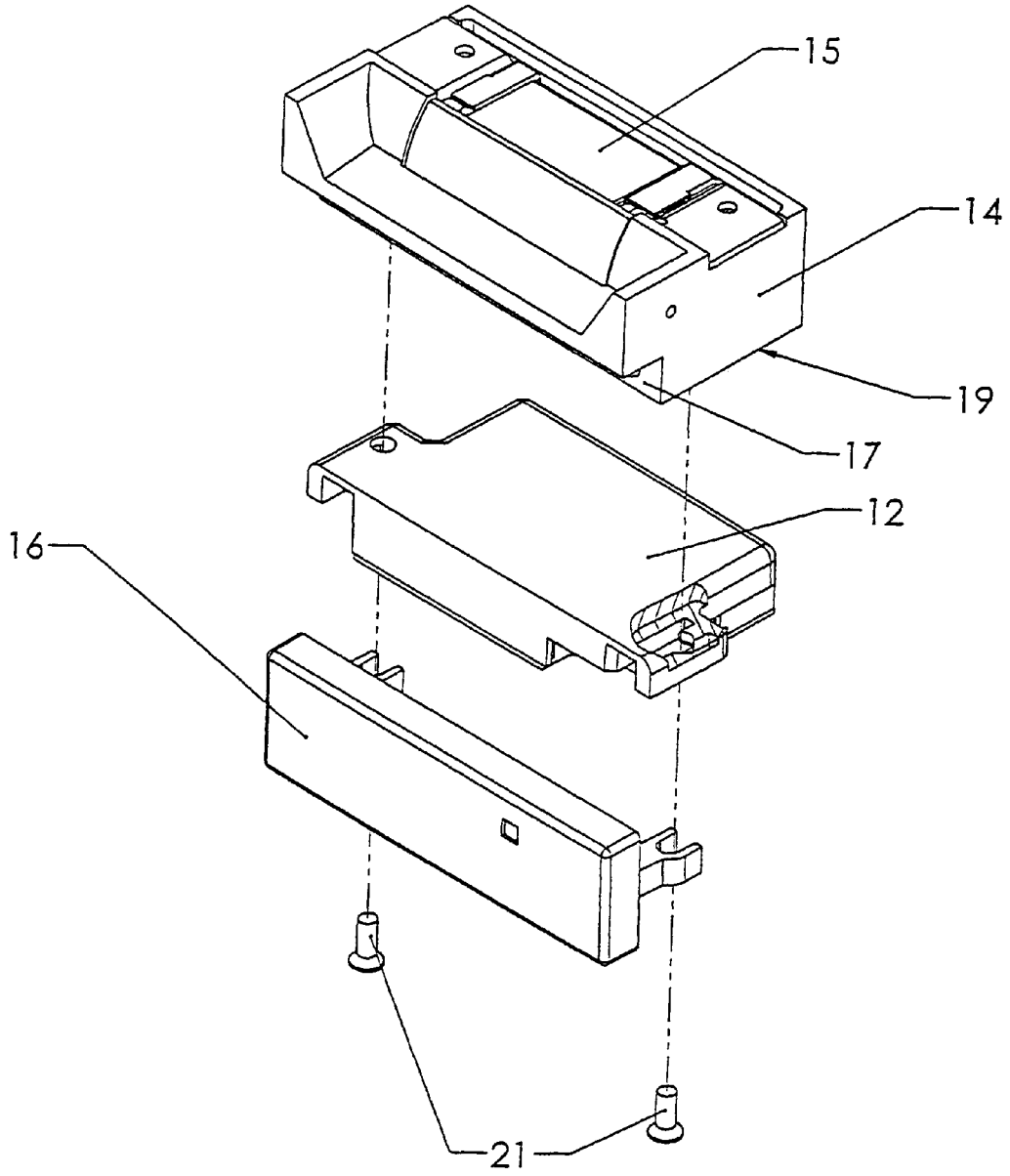
FIGS. 2A and 2B show a modular arrangement compatible with other existing electric strikes.

Turning now to the drawings, FIG. 1 shows an electric strike with an enclosed proximity reader 26. An integrated antenna 16 is secured to the side of the electric strike housing 10. FIG. 2A depicts an electric strike 14 defining an electric strike cavity 15 for receiving the bolt of a cooperating latch mechanism which is mounted on a closure such as a door, not shown. Attached to the electric strike is a proximity reader 12. The proximity reader includes a microcontroller containing a microprocessor which receives and decodes information from the attached antenna 16. Proximity readers which enable access control systems through the use of access cards or credentials are well known to those in the art and a detailed description of their operation is not believed necessary.

The proximity reader 12 is mounted to the lower surface 19 of the electric strike and preferably is similarly dimensioned. In the modular integration shown in FIG. 2A, the antenna is preferably positioned in a recess 17 in the underside of the electric strike 14 so that the proximity reader 12 and antenna 16 do not project beyond the sidewalls of electric strike 14. Once installed, the proximity reader is protected or shielded. The electric strike 14 and proximity reader 12 and antenna 16 are secured by bolts or screws 21 extending through the proximity reader into tapped holes in the electric strike.

Figure 2B:
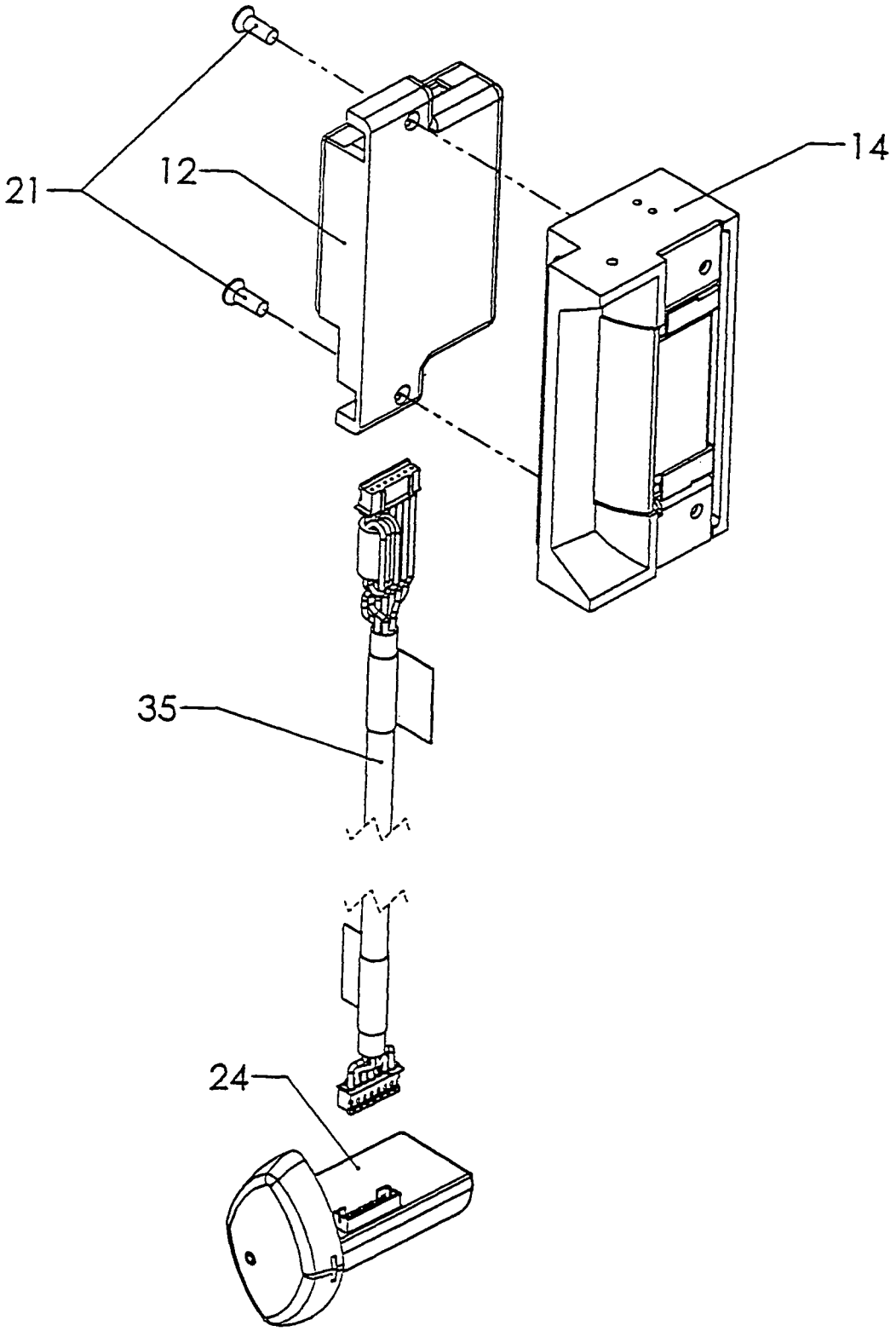

FIG. 2B shows the electric strike and proximity reader similar to that shown in FIG. 2A, but in FIG. 2B a remote antenna 24 is used and is connected to the proximity reader 12 by cable 35.

Figure 3:
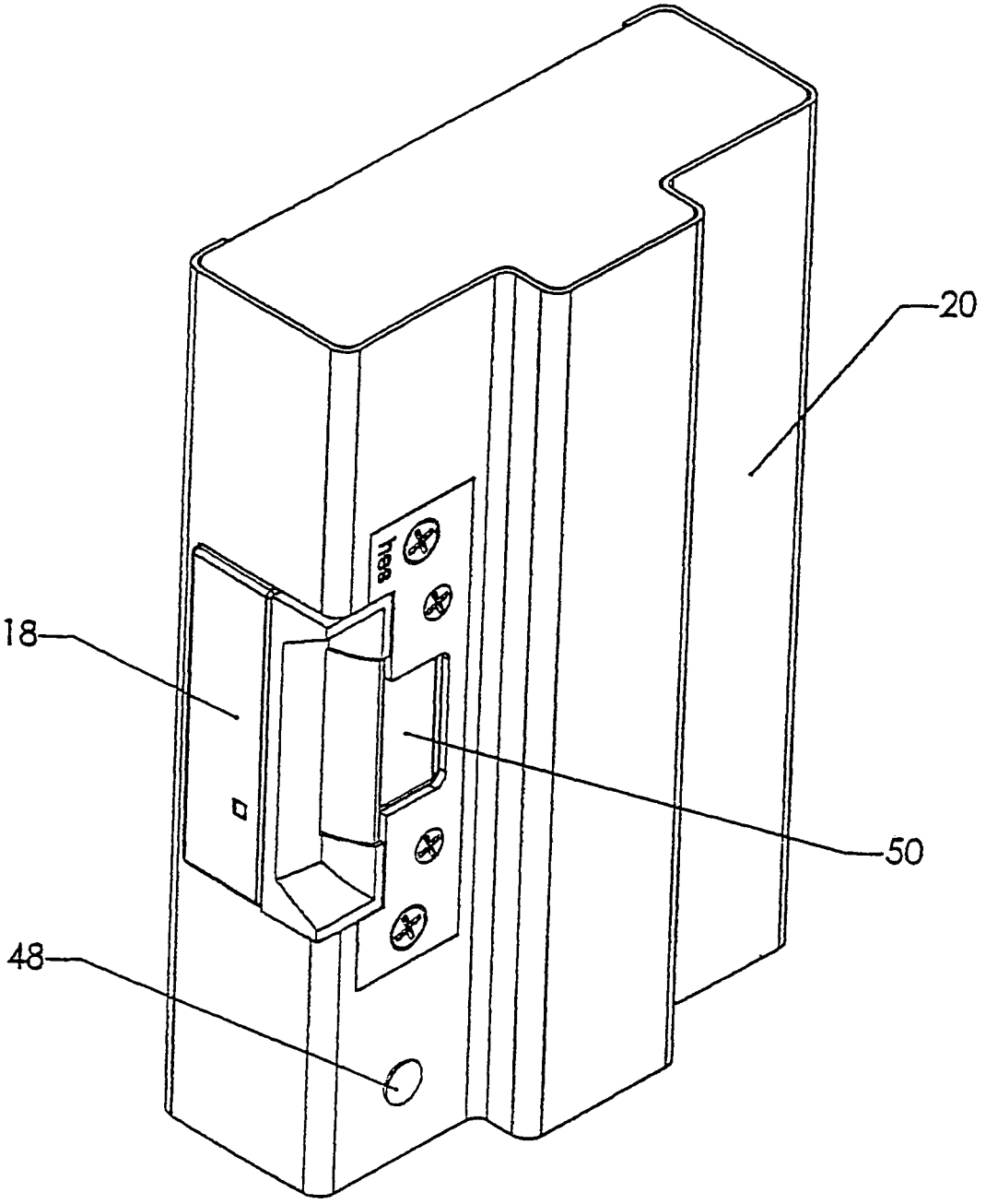

FIG. 3 depicts a door frame 20 containing an integrated electric strike, proximity reader and antenna assembly 18 which also incorporates a latch bolt monitor 50 and a door closed switch 48. These status switches can relay information to the access control panel through the proximity reader to provide additional door security information.

Figure 4:
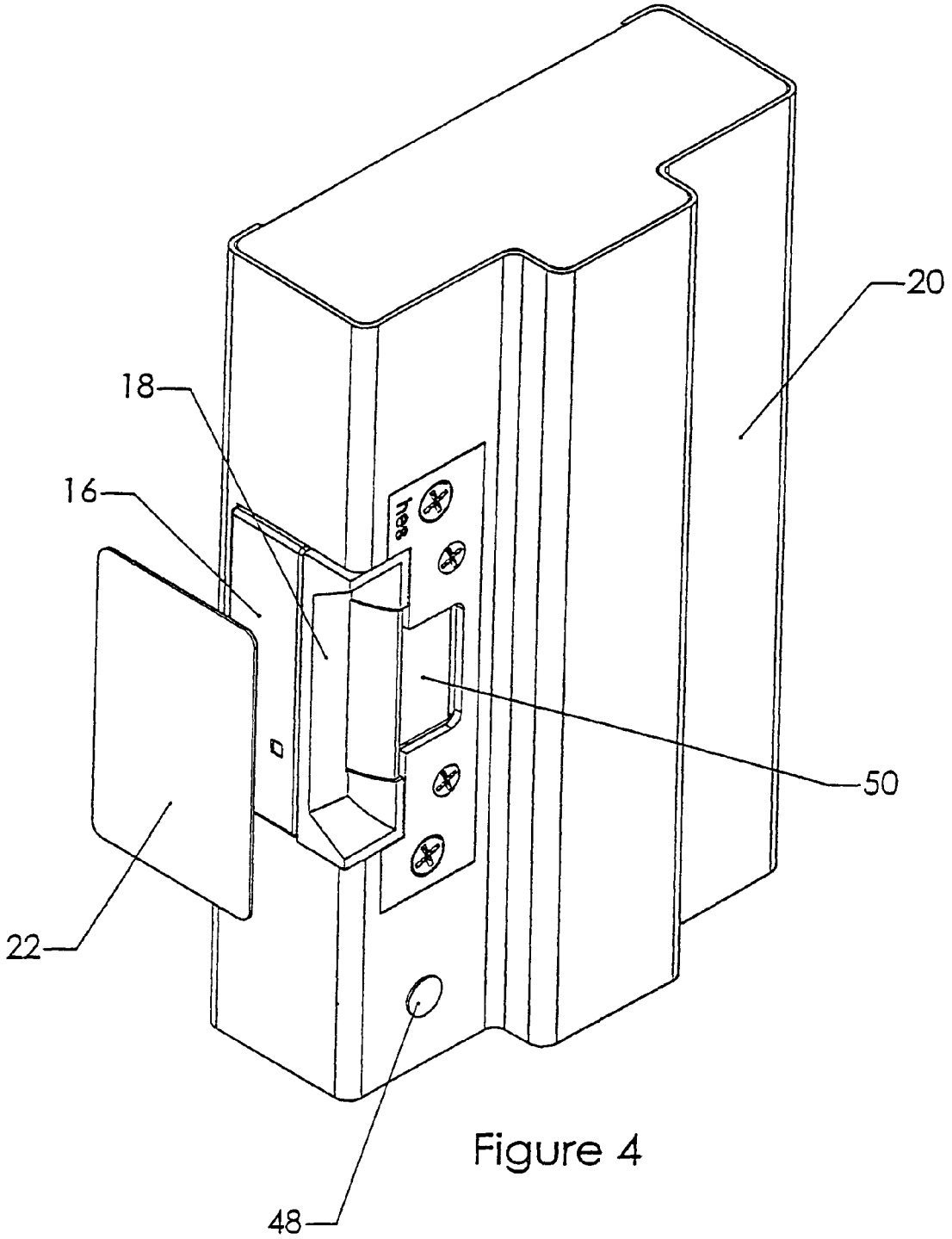

FIG. 4 shows all the parts described in FIG. 3 and adds an access control card, or credential, 22 positioned adjacent the integrated antenna 16.

Figure 5:
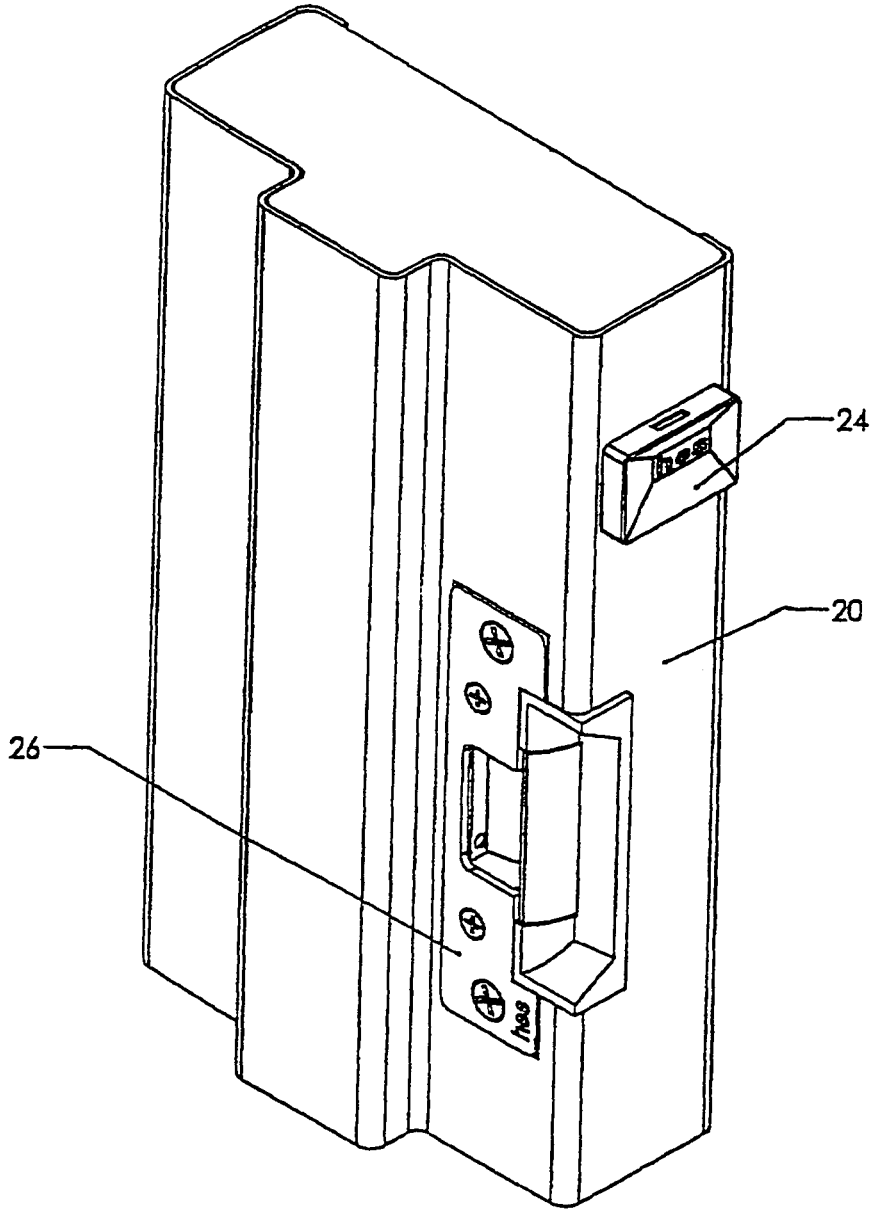
FIG. 5 shows an installation in which the remote antenna is mounted on the exterior of the frame and the proximity reader is incorporated in the electric strike.

In FIG. 5, an electric strike-proximity reader assembly 26 is mounted in a door frame 20 with a remote antenna 24 on the exterior of the door opening.

Figure 6:
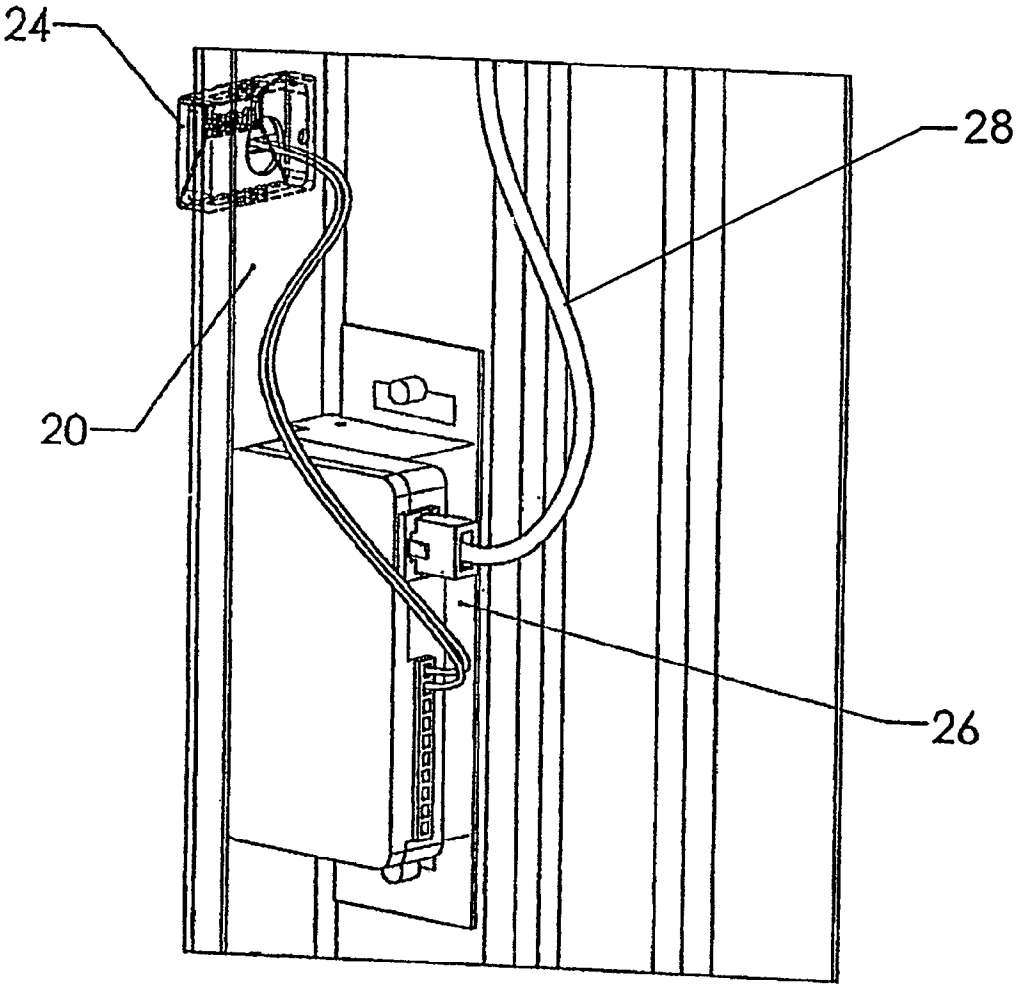
FIG. 6 shows an installation as viewed from the frame interior.

FIG. 6 is a view similar to FIG. 5, but viewed from inside the door frame to show the necessary interconnections between the remote antenna 24 and the proximity reader 12 and cable 28 connecting to a remote access control panel.

Figure 7:
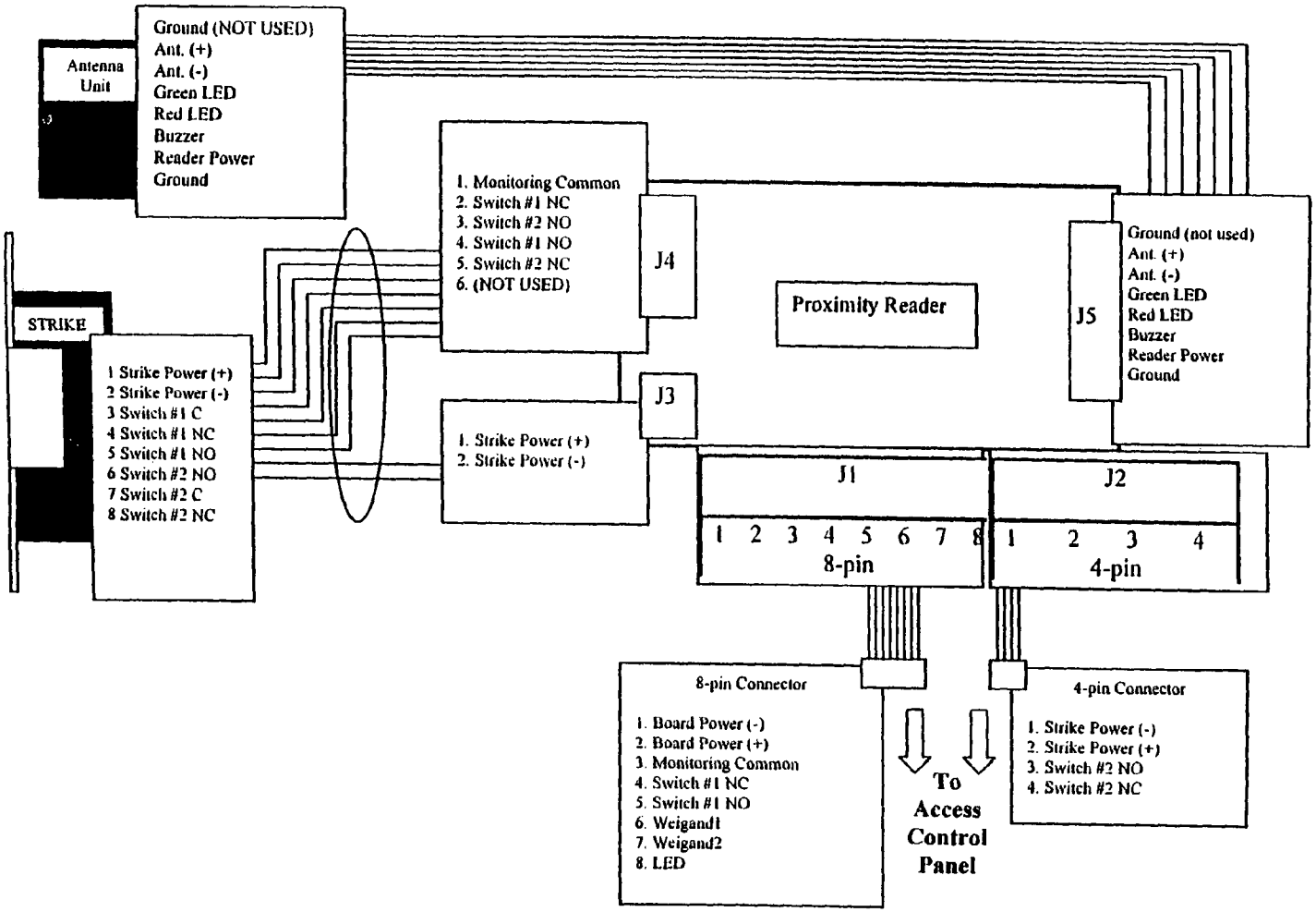
FIG. 7 is a functional block diagram showing the antenna, proximity reader, and electric strike interconnections as well as the outputs to the access control panel.

FIG. 7 shows a functional block diagram of the basic electric strike with proximity reader and antenna showing the interconnections required between the respective units. In this figure, the antenna may be remote or integrated into the unit with the electric strike and proximity reader.

Figure 8:
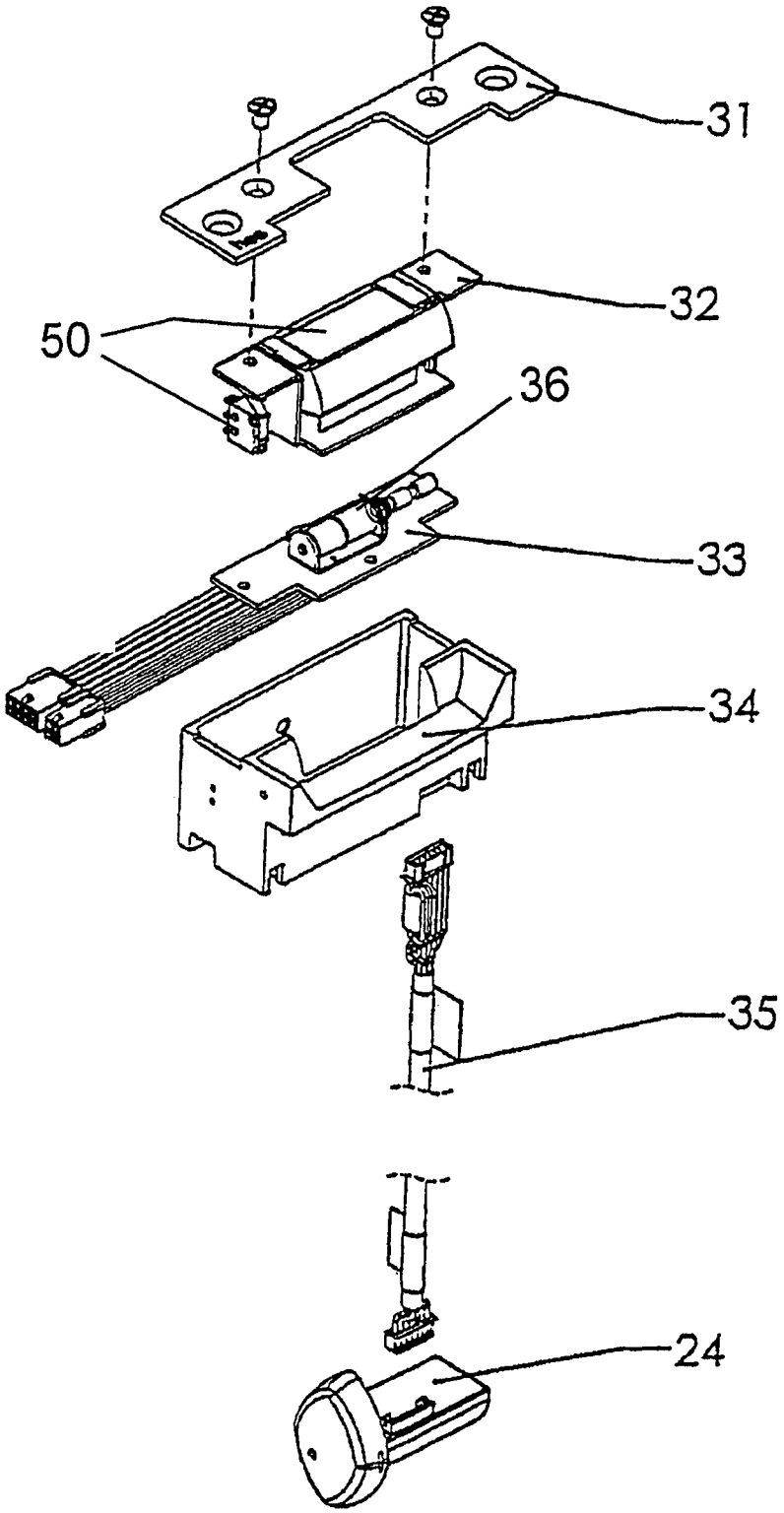
FIG. 8 shows an exploded view of the proximity reader and electric strike controller circuit which also contains the electric solenoid, mounted on the top side of the circuit board, as well as interconnections for the remote antenna, door position switch, and latch bolt monitor, said circuit board is mounted within the electric strike case.

FIG. 8 shows an exploded view of an integrated electric strike with proximity reader-electric strike controller circuit board 33 mounted within the electric strike housing 34. The proximity reader-electric strike controller circuit board 33 provides the mounting and lead connections for the electric strike solenoid 36. The circuit board 33 is further protected by the electric strike mechanism 32 and cover plate 31. The remote antenna 24 is connected to the circuit board at connector 37 by the connectors on cable 35. Latch bolt monitor 50 is connected through the circuit board 33 to the access control panel (not shown.).

Figure 9:
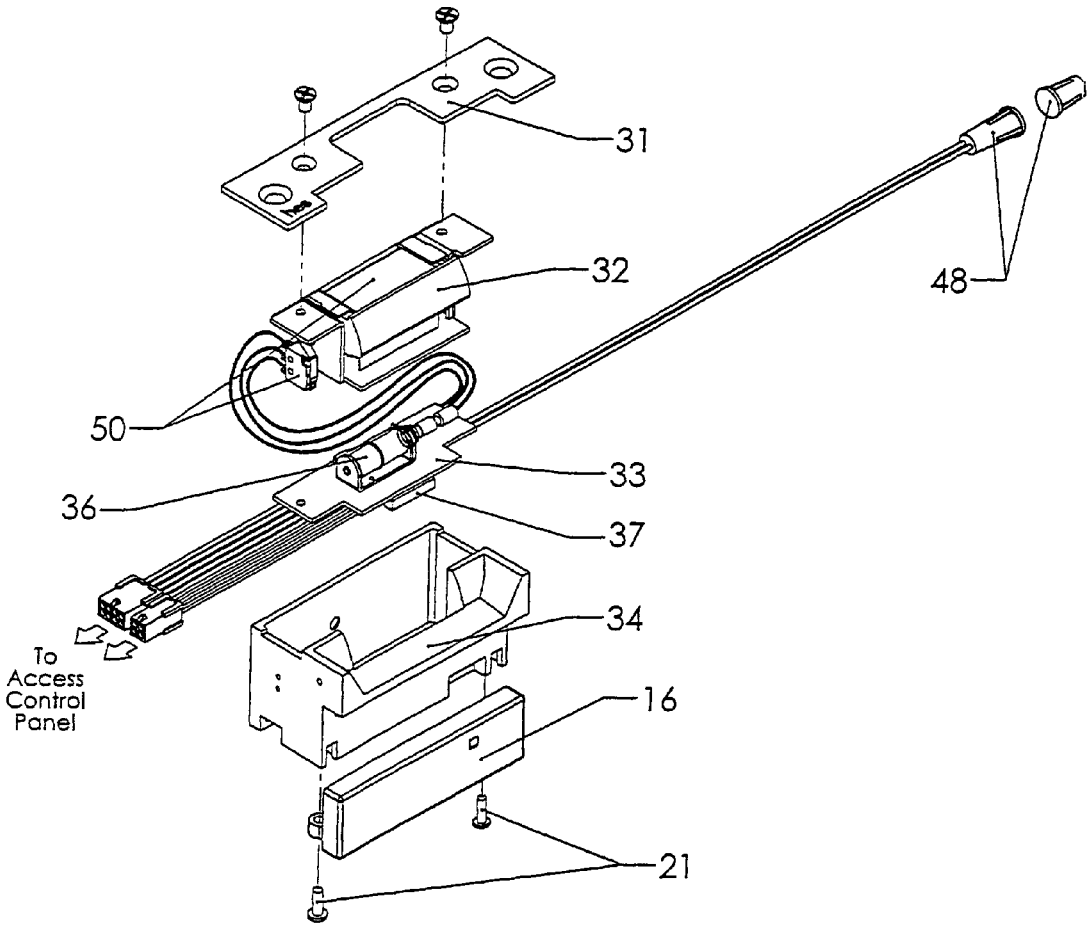
FIG. 9 is similar to FIG. 8, showing both the integrated proximity reader as well as the component parts of the electric strike and additionally showing an integrated antenna assembly mounted on the lip side of the electric strike.

FIG. 9 is similar to FIG. 8 except the integrated antenna 16 is mounted on a side of the electric strike housing 34 and is plugged directly into the proximity reader-electric strike controller circuit board 33 at connection 37 and attached by screws 21 to the electric strike housing 34.

Figure 10:
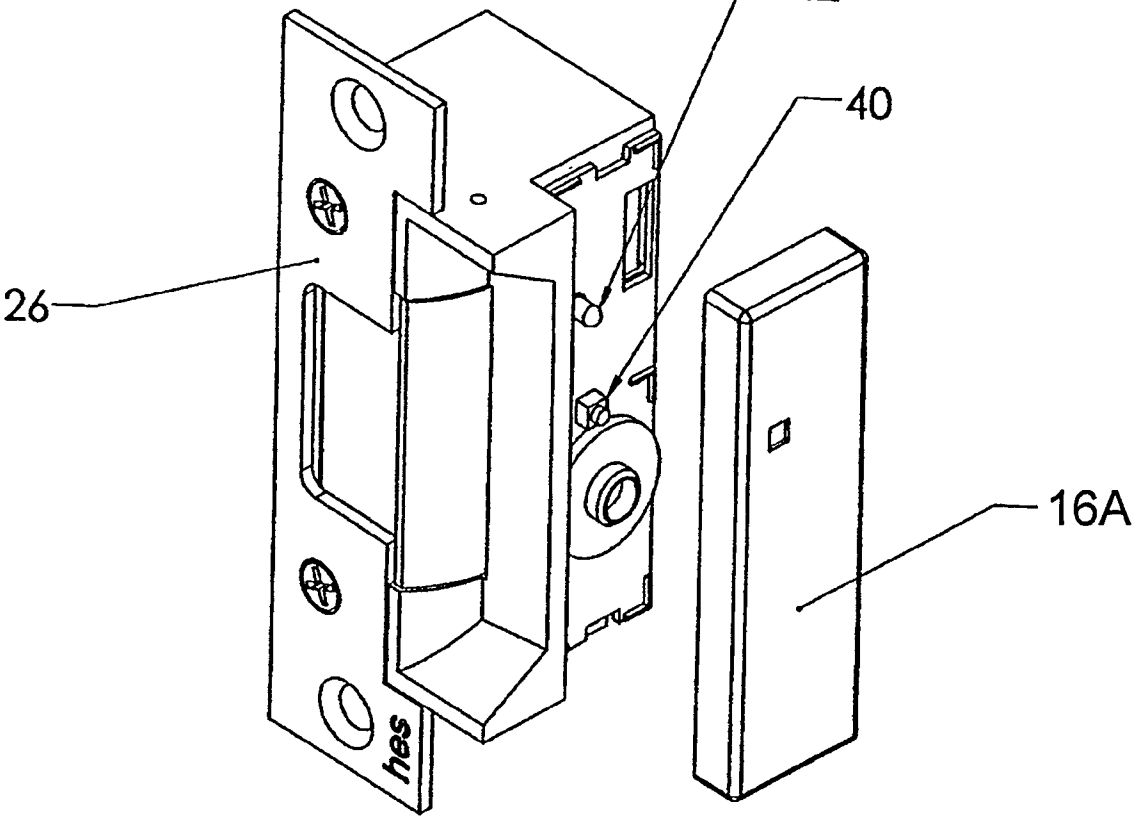
FIGS. 10 and 11 show a tamper switch which is incorporated to protect the integrated antenna as shown in FIG. 10 or the remote antenna shown in FIG. 11.
Figure 11:
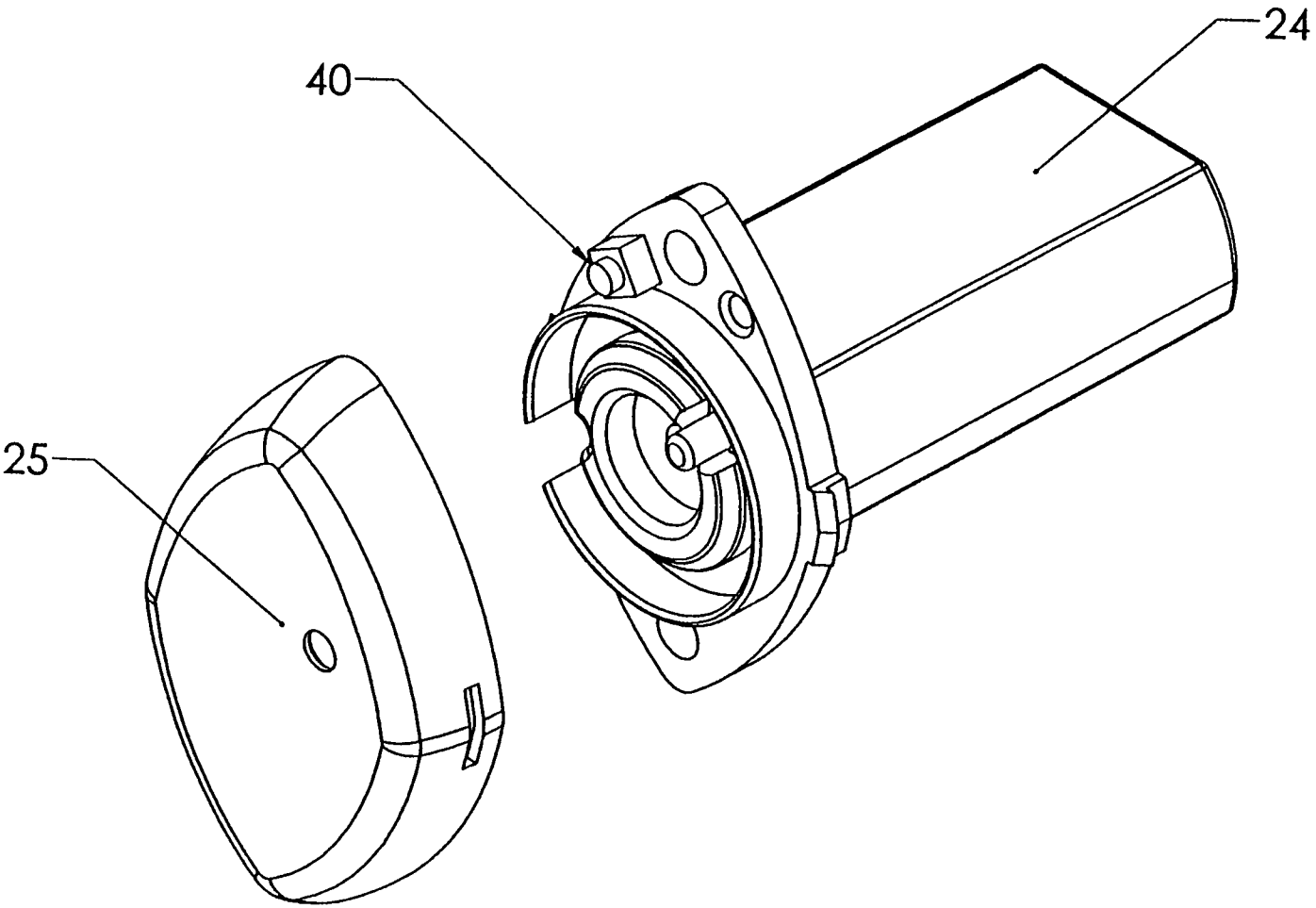

FIGS. 10 and 11 show a tamper switch 40 which may be mounted on the proximity reader-electric strike assembly 26 or mounted internally in the antenna housing 24 and enclosed by the antenna housing cover 25. The purpose of the tamper switch is to disable the electric strike and activate an alarm if tampering with the antenna housing 16A or 24, respectively, for purposes of unauthorized entry is detected.

Figure 13:
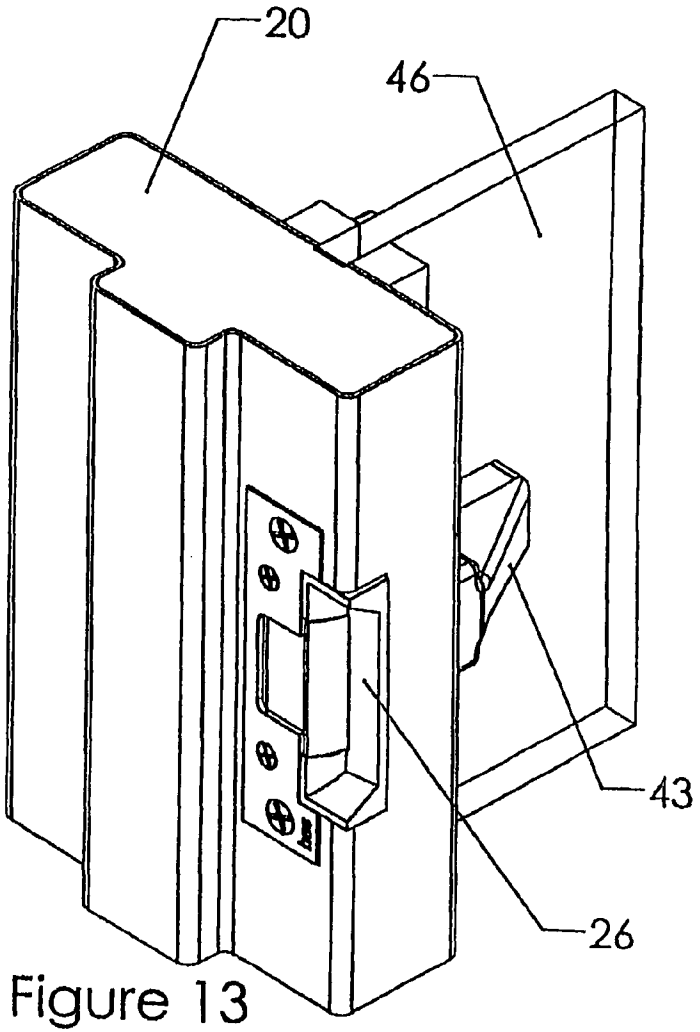
FIGS. 12 and 13 show two views of a remote antenna on the interior of the door opening which is fastened to the door frame adjacent to the side light, or window glass located next to the door frame.
Figure 12:
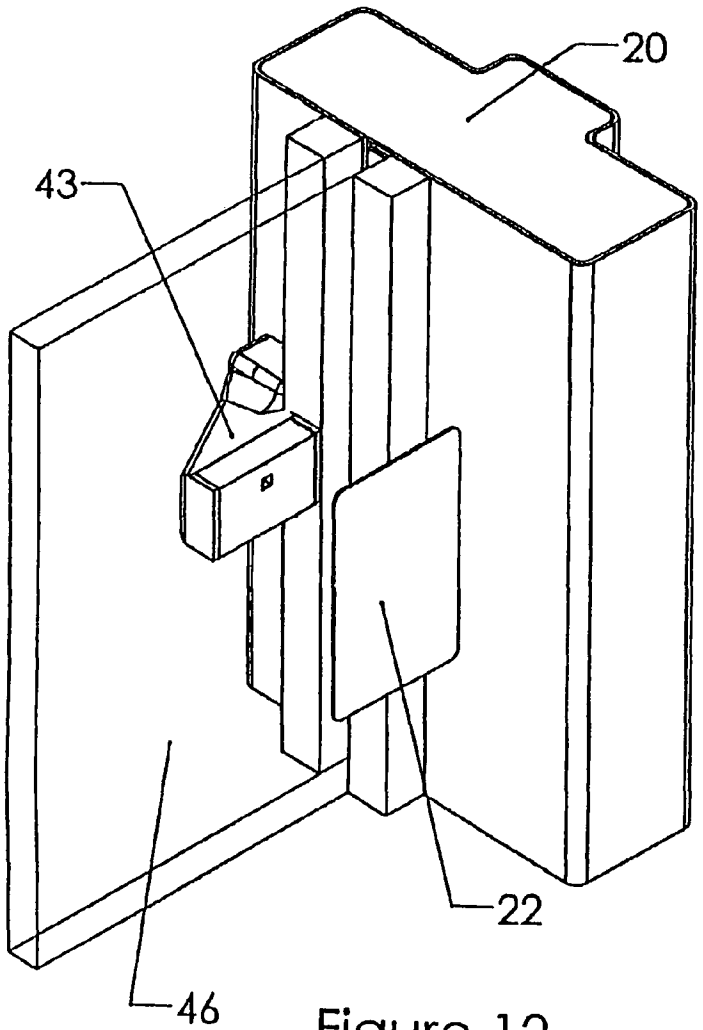

FIGS. 12 and 13 illustrate another embodiment in which a transparent window (side light) 46 adjacent the door frame 20 provides additional protection for the antenna 43. A proper access control card 22 may nevertheless be used and will communicate with the proximity reader-electric strike assembly 26, through the window, to unlock the door.

Figure 14:
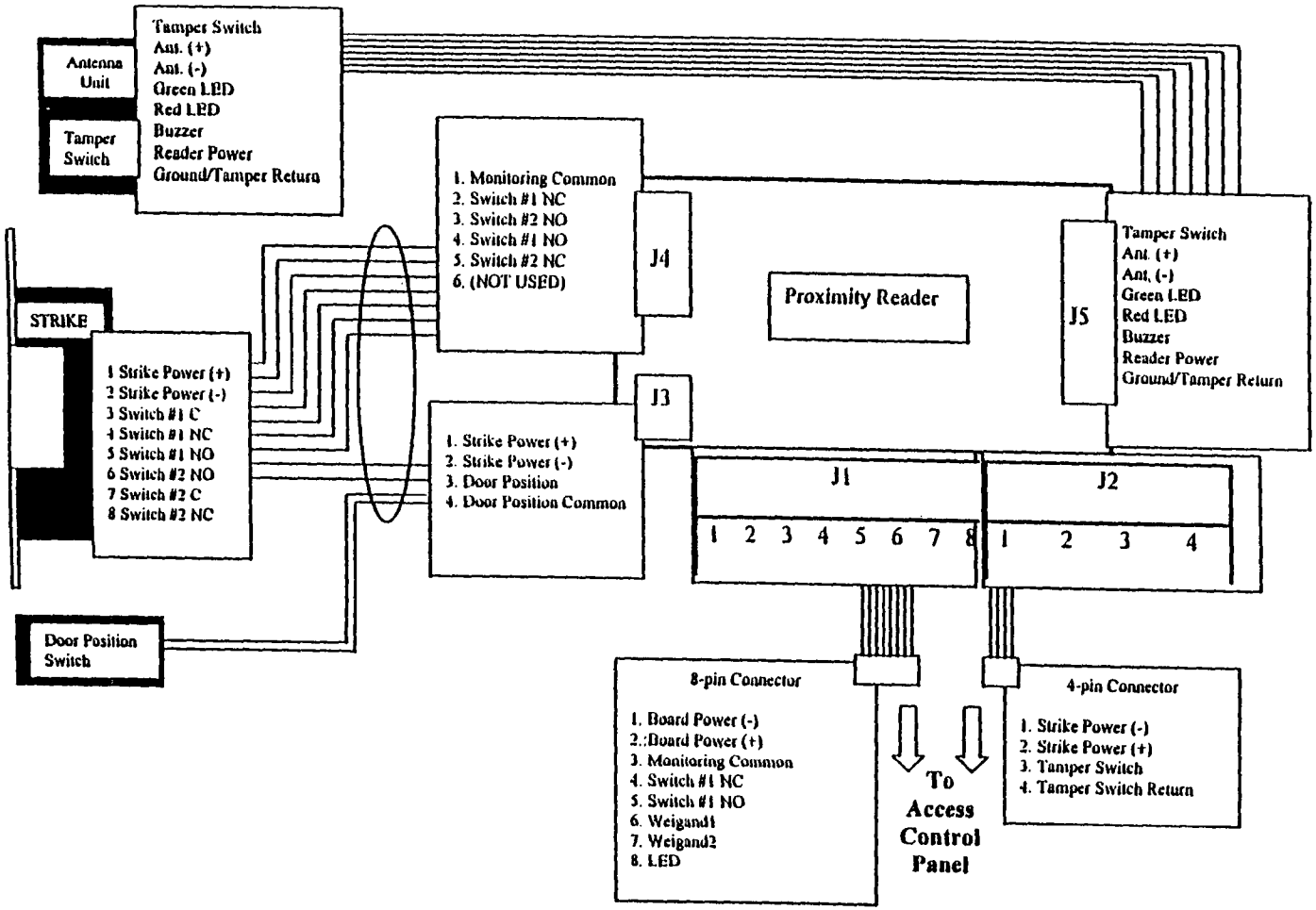
FIG. 14 shows a function block diagram of the proximity reader and electric strike controller circuit board, the monitoring switches, including the antenna tamper switch, the antenna, the electric strike, and the output to the access control panel.

FIG. 14 is a functional block diagram similar to FIG. 7 with the addition of circuitry incorporating the antenna tamper switch 40 and a door position switch 48. The door position switch affords further security by communicating the open or closed status of the door to the access control panel.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. An access control system for a door, said door having a latch, said access control system comprising:

(a) an electric strike housing including side walls and a bottom wall, said bottom wall including a first exterior surface;

(b) a face plate mountable to said electric strike housing, wherein said bottom wall of said electric strike housing is opposite said face plate when said face plate is mounted to said electric strike housing;

(c) an electric strike disposed within said electric strike housing, said electric strike cooperable with said latch to control opening and closing of said door; and (d) a proximity reader configured to receive and process signals, said proximity reader including a second exterior surface directly coupled with said first exterior surface of said electric strike housing to form a unit, wherein the entirety of said unit is configured for being installed in a door frame with said electric strike aligned with said latch, wherein said proximity reader is in a position shielded by said bottom wall of said electric strike housing, and wherein said proximity reader does not project beyond said side walls of said electric strike housing.

2. A method of installing a wireless access control system in a closure having a latch bolt and mounted in a frame, comprising:

(a) providing an electric strike housing including side walls and a bottom wall, said bottom wall including a first exterior surface;

(b) providing a face plate mountable to said electric strike housing, wherein said bottom wall of said electric strike housing is opposite said face plate when said face plate is mounted to said electric strike housing;

(c) providing an electric strike disposed within said electric strike housing, said electric strike cooperable with said latch bolt to control opening and closing of said closure;

(d) providing a proximity reader configured to receive and process signals, said proximity reader including a second exterior surface;

(e) directly coupling said second exterior surface of said proximity reader with said first exterior surface of said electric strike housing to form a unit;

(f) installing the entirety of said unit in said frame with said electric strike aligned with said latch bolt and with said proximity reader in a secure position within said opening in said frame at least partially shielded by said bottom wall of said electric strike housing;

(g) connecting said electric strike to a source of power;

(h) connecting said proximity reader to an access control panel; and (i) providing an antenna attached to said proximity reader, wherein said antenna is configured for receiving signals from and transmitting signals to said proximity reader.

3. The method of claim 2 further including attaching said antenna to said proximity reader at a location remote from said proximity reader.

4. The method of claim 3 wherein said antenna is attached adjacent a transparent window.

5. The access control system of claim 1 further comprising an antenna configured for receiving and transmitting signals to said proximity reader, wherein said antenna, said proximity reader and said electric strike housing are assembled into said unit.

6. The method of claim 2 wherein when said second exterior surface is disposed in contact with said first exterior surface, said proximity reader does not project beyond said side walls of said electric strike housing.

7. The access control system of claim 5 further including a tamper switch on said electric strike housing.

8. The access control system of claim 1 wherein said electric strike includes a latch bolt monitor.

9. An access control system for a door, said door having a latch, said access control system comprising:

(a) an electric strike housing including side walls and a bottom wall, said bottom wall including a first exterior surface;

(b) a face plate mountable to said electric strike housing, wherein said bottom wall of said electric strike housing is opposite said face plate when said face plate is mounted to said electric strike housing;

(c) an electric strike disposed within said electric strike housing, said electric strike cooperable with said latch to control opening and closing of said door;

(d) a proximity reader configured to receive and process signals, said proximity reader including a second exterior surface directly coupled with said first exterior surface of said electric strike housing to form a unit, wherein the entirety of said unit is configured for being installed in a door frame with said electric strike aligned with said latch, wherein said proximity reader is in a position shielded by said bottom wall of said electric strike housing, and wherein said proximity reader does not project beyond said side walls of said electric strike housing; and (c) an antenna configured for receiving and transmitting signals to said proximity reader.

10. The access control system of claim 9 wherein said antenna is remotely connected to said proximity reader.

11. The access control system of claim 9 further including a proximity card, wherein said antenna is configured for transmitting signals to said proximity card.

12. The method of claim 2 wherein said antenna is configured for transmitting signals to said access control panel.

* * * * *